US007017291B2

(12) United States Patent
Borucki

(10) Patent No.: US 7,017,291 B2
(45) Date of Patent: Mar. 28, 2006

(54) GAP REDUCTION SYSTEM AND METHOD FOR LAUNDRY PROCESSING

(75) Inventor: Martin T. Borucki, New Buffalo, MI (US)

(73) Assignee: Finishtech, Ltd., Morton Grove, IL (US)

( * ) Notice: Subject to any disclaimer, the term of this patent is extended or adjusted under 35 U.S.C. 154(b) by 264 days.

(21) Appl. No.: 10/436,208

(22) Filed: May 12, 2003

(65) Prior Publication Data

US 2004/0226198 A1 Nov. 18, 2004

(51) Int. Cl.
*D06F 67/04* (2006.01)

(52) U.S. Cl. ..... 38/143

(58) Field of Classification Search ..... 38/143, 38/7, 8, 9, 11, 1 C, 1 D; 198/459.8, 460.1, 198/460.3, 575, 576, 577, 461.1, 461.2
See application file for complete search history.

(56) References Cited

U.S. PATENT DOCUMENTS 3,075,630 A * 1/1963 Fisk ..... 198/572
3,880,421 A 4/1975 Muller
3,909,964 A 10/1975 Wenck
4,378,645 A 4/1983 Allen et al.
4,479,640 A 10/1984 Smith
4,514,963 A * 5/1985 Bruno ..... 53/493
4,967,495 A 11/1990 Weir
5,054,543 A 10/1991 Thomas et al.
5,172,502 A 12/1992 Kober
5,341,916 A * 8/1994 Doane et al. ..... 198/460.1
5,440,810 A 8/1995 Borucki et al.
5,515,627 A 5/1996 McCabe
5,540,647 A * 7/1996 Weiermann et al. ..... 493/444
5,687,641 A 11/1997 Williamson et al.
5,738,202 A * 4/1998 Ydoate et al. ..... 198/460.1
5,848,486 A 12/1998 Mitchell et al.
6,141,893 A 11/2000 McCabe
6,629,593 B1 * 10/2003 Zeitler ..... 198/460.1

* cited by examiner

*Primary Examiner*—Ismael Izaguirre
(74) *Attorney, Agent, or Firm*—Brinks Hofer Gilson & Lione

(57) ABSTRACT

Gaps between articles of laundry being passed between two automated laundry processing stations are reduced. By sensing a gap and accelerating an upstream conveyor, gaps between articles of laundry passed between stations are reduced. A reduction in gaps provides for more efficient and quicker processing of articles of laundry.

28 Claims, 1 Drawing Sheet

GAP REDUCTION SYSTEM AND METHOD FOR LAUNDRY PROCESSING

BACKGROUND OF THE INVENTION

The present invention relates generally to laundry machines. In particular, an apparatus and method reduces gaps between articles of laundry passed between two laundry stations.

In commercial laundry facilities, laundry articles, such as bed sheets, table linens, blankets, or the like, are fed into a flatwork ironer and/or automatic folder after being washed. In order to obtain neatly folded and unwrinkled laundry, the laundry articles should be presented to the ironer and/or folder with no wrinkles or folds and with the leading edge square.

One method for presenting the sheets with no folds employs operators to manually spread the sheet apart and to place the sheet in the ironer or folder by hand. However, the use of operators tends to slow the output of laundry processing equipment and can lead to inaccurate and inconsistent placement of the sheet. In addition, accurate placement of the sheet depends on the skill of the operators, so fatigued operators may increase costs.

To overcome the difficulties in using manual spreading, modern laundry facilities use automatic spreader-feeder machines. One machine of this spreader-feeder type is disclosed in U.S. Pat. No. 5,440,810, assigned to the assignee of the present invention. These spreader-feeder machines typically include a continuous moving feed conveyor on which the sheets are automatically laid with their leading edges perpendicular to the conveyor belts. In order to position the sheet for placement onto the conveyor, a pair of spreading clamps grip opposing top corners of the sheet. A user manually inserts the corners into the clamps. The spreading clamps are then moved apart by one or more endless belts or cables to spread the sheet. Once the sheet is spread, the spreading clamps release the corners of the sheet, and the upper portion of the sheet is forced onto the conveyor. The conveyor then advances the sheet to the ironer or other processing equipment.

One disadvantage of many spreader-feeder machines is the time required for the operator to isolate the corners of the sheet and load these corners into the clamps. A spreader-feeder disclosed in U.S. Pat. No. 5,515,627, assigned to the assignee of the present invention, overcomes this disadvantage. The user merely isolates an edge and feeds the edge in between pinch rollers. The spreader-feeder machine then isolates the corners and spreads the sheet.

The exit conveyor of the spreader-feeder machine passes the articles of laundry to one of a flatwork ironer or an automatic folder. An exit conveyor of the flatwork ironer may pass the articles of laundry to an automatic folder. An automatic separator machine may pass articles of laundry to the spreader-feeder. Each subsequent automatic laundry station operates at a similar or faster conveyance speed than the previous automatic laundry station. The difference in speeds prevents the front portion of an article of laundry from bunching or being wrinkled by passing from a faster conveyor to a slower conveyor (i.e. the article of laundry instead passes to a conveyor of a same or increased speed). However, these speed requirements may prevent one or more of the automatic laundry stations from operating a quickly as possible. Delays at one station introduce gaps between the articles of laundry conveyed between stations, resulting in inefficient use of the subsequent stations.

Exit conveyors passing articles of laundry to laundry operators rather than another station may include sensors for detecting the presence of an article of laundry on the conveyor. If an article of laundry is not present at a certain position, then the conveyor is slowed to provide extra time for the laundry operator to deal with laundry at the end of the conveyor. Similarly, where a station looses an article of laundry, an exit conveyor may be slowed to prevent a large gap between a previously exited article of laundry and the next article of laundry. However, this slow down results in even larger gaps being provided between another downstream pair of articles of laundry.

Another exit conveyor passes article of laundry to operators after separation. To provide articles of laundry to an operator more efficiently, the presence of an article is determined. If an article is not present on an exit conveyor due to an operator removing the article, the conveyor is accelerated to provide the next article to the operator more quickly.

BRIEF SUMMARY

Although the present invention is defined by the following claims, and nothing in this section should be taken as a limitation on those claims. By way of introduction, the preferred embodiments described below include methods and systems for eliminating or reducing gaps between articles of laundry passed between two automated laundry processing stations. By sensing a gap and accelerating an upstream conveyor, the gaps between articles of laundry passed between stations are reduced. A reduction in gaps provides for more efficient and quicker processing of articles of laundry.

In a first aspect, a method for reducing gaps between articles of laundry passing between two laundry processing stations is provided. A gap between a first article of laundry and a second article of laundry is sensed. A first conveyor supporting the second article of laundry is accelerated in response to sensing the gap. The gap between the first and second articles of laundry decreases in response to the acceleration.

In a second aspect, a gap reduction system for passing laundry between two stations is provided. A first conveyor is at an output of a first automated laundry processing station. A motor connects with the first conveyor. A sensor is positioned adjacent to the first conveyor to detect a gap between two articles of laundry. A controller is responsive to the sensor. The controller is operative to cause the first motor to accelerate the first conveyor in response to the detection of the gap.

In a third aspect, a method for reducing gaps between articles of laundry passing between two laundry processing stations is provided. A trailing edge of a first article of laundry on a first conveyor is sensed. The first conveyor is accelerated in response to the sensing of the trailing edge. The leading edge of a second article of laundry on the first conveyor is sensed. The first conveyor is decelerated in response to the sensing of the leading edge.

In a fourth aspect, a method for reducing gaps between articles of laundry passing between two laundry processing stations is provided. A leading edge of a first article of laundry on a first conveyor is sensed. The first conveyor is decelerated in response to the sensing of the leading edge. A trailing edge of the first article of laundry is then sensed. The first conveyor is accelerated in response to sensing of the trailing edge.

The foregoing and other features and advantages of the invention will become further apparent from the following detailed description of the presently preferred embodiments, read in conjunction with the accompanying drawings.

BRIEF DESCRIPTION OF SEVERAL VIEWS OF THE DRAWINGS

The components of the figures are not necessarily to scale, emphasis instead being placed upon illustrating the principles of the preferred embodiments. Moreover, in the figures, like reference numerals designate corresponding parts throughout the different views.

DETAILED DESCRIPTION OF THE PREFERRED EMBODIMENTS

A single conveyor with an associated sensor reduces gaps between articles of laundry passed from one automated laundry processing station to another automated laundry processing station. The gap is reduced without slowing down the operation of the upstream processing station. The reduction in the gap may maximize the efficiency of a downstream laundry processing station. For example, the input rate of a feeder is maximized by occasionally speeding up the feeder exit conveyor to reduce the gap between articles of laundry. By reducing the gap, a downstream ironer is provided with articles of laundry for ironing with minimal spaces or gaps.

Figure 1:
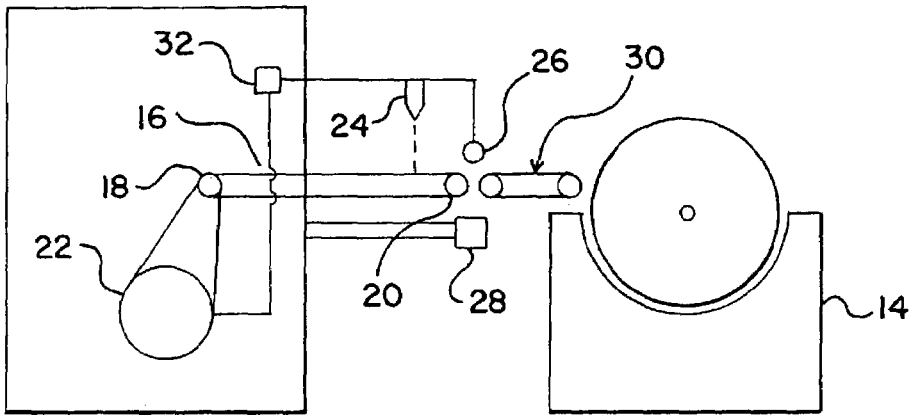
FIG. 1 is a graphical representation of two automated laundry processing stations of one embodiment.

FIG. 1 shows a gap reduction system for passing laundry between two laundry stations 12, 14. The same system may be provided at the output of any station within a series of two or more stations. As shown in FIG. 1, the system is provided on the output of a spreader-feeder station 12 for reducing the gaps between articles of laundry provided to an ironer station 14. Other possible stations include folding and separating stations. Other now known or later developed automated laundry processing stations may be used. Automated laundry processing stations minimize or eliminate user handling of articles of laundry, such as sheets or towels. Any combination of automated laundry processing stations may be used, such as a separator outputting articles of laundry to a spreader-feeder station which outputs articles of laundry to an ironer station which outputs articles of laundry to a folder station.

The spreader-feeder station 12 is any one of various now known or later developed spreader-feeders, such as disclosed in U.S. Pat. Nos. 5,172,502, 5,440,810, 5,515,627 and 6,141,893, the disclosures of which are incorporated herein by reference. Other spreader-feeder stations for use by one or more operators may be provided. For example, the spreader-feeder stations disclosed in U.S. Pat. No. 6,141,893 or U.S. Pat. No. 5,515,627 with multiple operators inputs or spreaders for feeding sheets or towels to the station 12 are provided.

The ironer station 14 is any of a rotary ironer, cylinder ironer, gas burner ironer, fluid conduction ironer, chest ironer or other ironers now known or later developed may be used. For example, the ironers disclosed in U.S. Pat. No. 5,054,543 or U.S. Pat. No. 5,848,486, the disclosures of which are incorporated herein by reference, may be used.

A portion of the spreader-feeder station 12 operates as a gap reduction system. The gap reduction system is part of a different station in other embodiments. The gap reduction system includes a conveyor 16, a motor 22, a sensor 24, an optional first air tube 26, an optional second air tube 28, and a controller 32. Additional, different or fewer components may be provided, such as an additional conveyor or sensor or only one or none of the air tubes 26 and 28.

The conveyor 16 is a feed conveyor extending horizontally between sidewalls of the spreader-feeder station 12. The conveyor 16 includes a plurality of spaced apart, flexible endless belts which extend around a front roller 18 and a rear roller 20. The front roller 18 is driven through an endless belt by the motor 22. The rear roller 20 is an idler roller. In alternative embodiments, the rear roller 20 is driven and the front roller 18 is an idler roller. Other conveyor arrangements with more or fewer belts and additional or fewer rollers may be provided. The conveyor 16 is at an output of the station 12, but may be at an input to a subsequent station 14. The belts of the conveyor 16 are driven in a direction such that the upper run of belts moves rearwardly away from the station 12 and the lower run moves forwardly towards the station 12. When an article of laundry, such as a sheet, is fed onto the conveyor 16, the article of laundry is advanced rearwardly towards the subsequent station 14, such as an ironer or folder.

The motor 22 comprises an electric motor, such as a one-half horsepower 0.374 KW electrical motor, but other horsepower and associated watt ratings may be used. Alternatively, other motors now known or later developed, such as pneumatic or air pressure driven motors, may be used. While one endless belt is shown connecting the motor 22 to the roller 18, a series of belts, gears and/or pulleys may be used for interconnecting the motor 22 to the conveyor 16. A clutch assembly connects the motor 22 to a portion of the conveyor 16 in alternative embodiments.

The sensor 24 is a photo sensor, such as a light beam sensor for transmitting a beam of light and receiving any reflection. Any of various photo sensors may be used, such as photo sensors made by MicroSwitch. Other sensors operable to detect the presence or absence of an article of laundry may be used. The sensor 24 is positioned adjacent to the conveyor 16 to detect a gap between articles of laundry being conveyed on the conveyor 16. The sensor 24 is positioned above the conveyor 16 over a last half of the conveyor 16, but may be positioned below the conveyor 16 and/or at a first half of the conveyor 16. For example, the sensor 24 is positioned about 8–10 inches from an end of the conveyor near the roller 20 and at the center of the conveyor run. The distance of the sensor 24 from the end of the conveyor 16 is determined as discussed below based on the conveyor's 16 ability to decelerate to a substantially same speed as the conveyor 30. Other positions closer or further from the end and at various locations laterally along the conveyor run may be used. In one embodiment, the sensor 24 is positioned such that an emitted beam of light will pass between belts on the conveyor 16 when not blocked by an article of laundry, but the sensor 24 is positioned to direct the beam of light at one or more belts in alternative embodiments. The sensor 24 is connected with the station 12.

Alternatively, the sensor 24 connects with the subsequent station 14 or is a free-standing device unconnected to either station. The sensor 24 detects the presence of an article of laundry, including detecting or sensing a trailing edge or leading edge of an article of laundry as the laundry is conveyed past the sensor 24. In alternative embodiments, a plurality of sensors are provided to detect the leading or trailing edge of articles of laundry at a same or different times or in different positions.

The controller 32 is a microprocessor, digital signal processor, application specific integrated circuit, analog components, digital components and combinations thereof. In one embodiment, the controller 32 is a controller used for operating and controlling at the station 12, such as controlling additional functions of the station 12. For example, the controller 32 also controls the motor 22 in response to sensing whether articles of laundry continue to be in-fed to the station so that the conveyor 16 is stopped when articles of laundry are no longer being fed to the conveyor 16. A separate controller for operation of the gap reduction system may be provided. The controller 32 is responsive to the sensor 24 to cause the motor 22 to accelerate the first conveyor 16 in response to the detection of a gap. The controller 32 also responds to the sensor 24 to cause the motor 22 to decelerate the conveyor 16 in response to the end of a gap.

The air tube 26 is a metal, plastic or other material cylinder, bar or other shape with a plurality of holes or nozzles. The air tube 26 extends horizontally over the end of the conveyor 16 or at a gap between the conveyor 16 and an in-feed conveyor 30 of the subsequent station 14. By positioning the air tube 26 adjacent to the exit end of the conveyor 16, forced air is directed towards the exit end of the conveyor 16 for urging an article of laundry through the gap between the two conveyors 16 and 30. The air tube 26 includes an electrically or pneumatically operated valve for turning on and turning off the release of air from the air tube 26. The valve is responsive to the controller 32 or another controller.

As an alternative or an addition to the air tube 26, the air tube 28 with openings is provided. The air tube 28 is a plastic, metal or other material cylinder, bar or other shape positioned horizontally below the exit of the conveyor 16. The air tube 28 connects to a source of vacuum. When switched on, the vacuum draws an article of laundry through the gap between the conveyors 16 and 30 due to a suction force. The controller 32 or another controller operates a pneumatic or electric valve for turning on or turning off the vacuum applied to the air tube 28.

The air tube 26 is positioned adjacent to the exit of the conveyor 16 about 2–3 inches above the conveyor, but other positions may be provided. The air tube 28 is positioned about an inch below the conveyor 16 in order to better focus the suction force to the gap in the conveyor. Different positions of either air tube 26, 28 may be used. The air tubes 26, 28 are connected with or formed as part of the first station 12. In alternative embodiments, the air tubes 26, 28 connect with the subsequent station 14 or are free-standing.

The second automated laundry processing station 14 includes an input. In the embodiment shown in FIG. 1, the input is a conveyor 30, but other inputs with additional conveyors or without a conveyor may be used. The input conveyor 30 of the station 14 is disposed to receive articles of laundry from the conveyor 16 of the previous station 12. For example, the conveyors 16, 30 are positioned so that the rollers of the conveyors extend parallel to each other at a same level with about a quarter inch gap, but other gap sizes may be used, between the two conveyors 16 and 30. The conveyor 16 conveys articles of laundry to the input, such as the conveyor 30, without operator contact. The articles of laundry are automatically fed from the first station 12 to the subsequent station 14. As shown, the feeder conveyor 16 is longer than the input conveyor 30, but the same length or different relative lengths may be provided. The input conveyor 30 conveys an article of laundry to the station 14, such as to an ironing drum for ironing.

Figure 2:
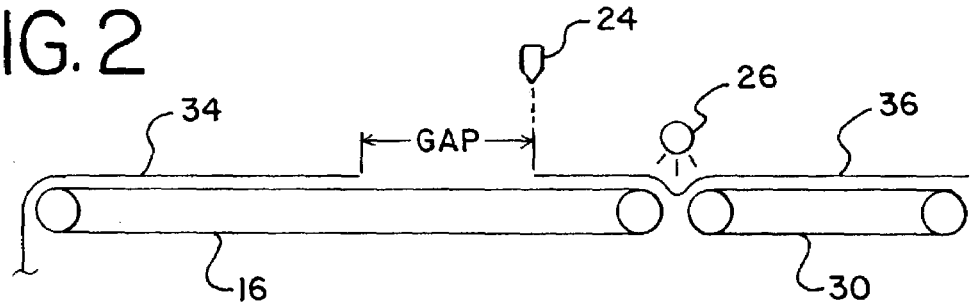
FIG. 2 is a graphical representation of two conveyors, two articles of laundry, and a sensor for eliminating a gap in one embodiment.
Figure 3:
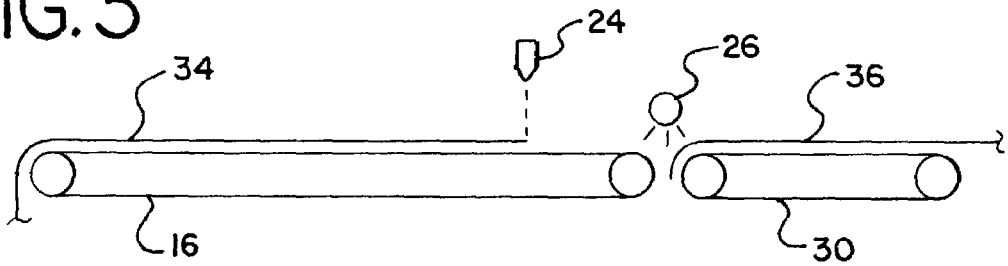
FIG. 3 is the graphical representation of FIG. 2 with the articles of laundry in a downstream position at a later time.
Figure 4:
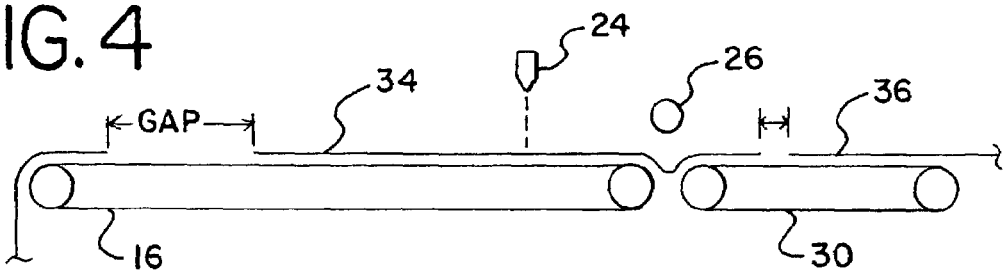
FIG. 4 is a graphical representation of the embodiment of FIGS. 2 and 3 with the articles of laundry in yet another downstream position at an even later time.

FIGS. 2 through 4 represent methods for reducing gaps between articles of laundry passing between two laundry processing stations 12, 14. The conveyor 16 operates at a substantially same speed as the conveyor 30. Substantially is used to account for variation in speeds due to wear of parts, as well as intentional differences in speed due to the subsequent processing of laundry. For example, the subsequent conveyor 30 operates at a slightly faster speed in general than the conveyor 16, such as from 1–20% faster. In one embodiment, the subsequent conveyor 30 operates at between 100–150 feet per minute, and the conveyor 16 operates at about the same speed or up to 5% slower. By accelerating the conveyor 16 relative to the conveyor 30, the gap between two articles of laundry 34, 36 may decrease.

As articles of laundry 36 and 34 are placed onto the conveyor 16, a gap between each subsequent article of laundry, such as the gap between articles of laundry 36 and 34 may occur. Occasionally, no gap may occur. The gap may vary between any two articles of laundry, such as from inches to the full length of the conveyor 16 (e.g., four feet). As an article of laundry, such as the first article of laundry 36, passes beneath the sensor 24, the light beam reflects back from the article of laundry and does not pass into open air beyond the conveyor 16. As a result, the sensor 24 senses the presence of an article of laundry.

As the articles of laundry are conveyed by the conveyor 16 away from the station 12, the sensor 24 detects the gap between the article of laundry 36 and the article of laundry 34. The gap is sensed by detecting a trailing edge of the article of laundry 36. In alternative embodiments, the gap is sensed by also detecting a leading edge of the subsequent article of laundry 34. The sensor 24 may be used to detect both the trailing edge of a first article of laundry 36 as well as subsequently detecting a leading edge of a subsequent article of laundry 34. Either the presence of the gap is sensed or the length of the gap is sensed. In alternative embodiments, the gap is sensed by detecting other portions of an article of laundry, by detecting a length of an article of laundry, by detecting an amount of time to process each article of laundry in the station 12, or by other mechanisms for determining the presence, position and/or length of a gap.

In response to the detection of the gap between the articles of laundry 36, 34 on the conveyor 16, the conveyor 16 is accelerated. Once the gap is sensed or a time period after the gap is sensed, the conveyor 16 is accelerated to a speed that is faster than the subsequent conveyor 30. Any amount of acceleration may be used such that the article of laundry 16 stays flat on the conveyor 16. The acceleration continues until a desired speed is reached or deceleration is started. For example, the conveyor 16 is accelerated to a speed that is 10–50%, 20–40%, 30% or more faster than the subsequent conveyor 30, such as accelerated to 200–220 feet per minute. As a result of the acceleration, the subsequent article of laundry 34 is conveyed on the conveyor 16 towards the conveyor 30 at a rate faster than the prior article of laundry 36 is being conveyed on the downstream conveyor 30. The conveyor 30 maintains a same speed, but may be accelerated or decelerated.

As a result of the acceleration of the conveyor 16 and position of the sensor 24 away from the end of the conveyor 16, a trailing portion of the article of laundry 36 is conveyed at a speed greater than the leading portion of the same article of laundry 36 on the downstream conveyor 30. To avoid wrinkles or bunching of the article of laundry 36, the air tube 26, air tube 28 or both are activated to apply force via air to the trailing portion of the article of laundry 36. Since the air is applied at the gap, the trailing portion of the article of laundry is forced through the gap between the conveyor 16 and the input, such as conveyor 30, as shown in FIG. 3. The blast of air or suction is applied for a time period responsive to the speed of the conveyor 16 and the distance of the sensor 24 from the end of the conveyor 16. For example, the air is applied at a beginning of acceleration and while the trailing portion of the article of laundry 26 is still on or has just left the conveyor 16. The air force may be applied for a lesser or a greater amount of time. In one embodiment, the time period is a set time period, but a time period that varies with one or more inputs for detecting the continuing position of the trailing edge may be used. A mechanical device, such as a moving arm, or other device for applying force alternatively pushes the trailing portion through the gap.

In one embodiment, additional inputs are used to control the amount or activation of the acceleration of the conveyor 16. For example, if a subsequent article of laundry, such as article 34 is not placed on the conveyor 16 by the time the trailing edge of the previous article of laundry 36 is detected by the sensor 24, acceleration is not performed as the feeder station 12 may be malfunctioning or not used. As another example, a feedback may be provided from the subsequent station 14 indicating the need to slow down conveyance of articles of laundry to the subsequent station 14. Alternatively, additional inputs are not used.

The first conveyor is accelerated to be faster than the second conveyor 30 for a time period responsive to the length of the gap. Alternatively, the acceleration occurs for a set time period or the acceleration continues until the end of the gap is detected.

To determine the end or length of the gap, a leading edge of a subsequent article of laundry 34 is sensed. As shown in FIG. 3, the sensor 24 senses a leading edge of the article of laundry 34 on the conveyor 16. Due to the acceleration and subsequent faster speed of the conveyor 16 relative to the conveyor 30, the article of laundry is conveyed forward at a speed greater than the article of laundry 36 on the downstream conveyor 30, reducing the gap. As an alternative to sensing the leading edge of the subsequent article of laundry 34, a timer is used or other portion of the subsequent article of laundry 34 is sensed. As yet another alternative, the trailing edge of the subsequent article of laundry 36 is sensed again rather than sensing the end of the gap for subsequent deceleration of the conveyor 16.

In response to determining the end of the gap or the leading edge of the subsequent article of laundry 34, the conveyor 16 is decelerated. The deceleration occurs suddenly or gradually based on any clutch mechanism or operation of the motor 22. In one embodiment, the deceleration occurs gradually such that by the time the leading edge of the article of laundry 34 is at the end of the conveyor 16, the conveyor 16 is operating at substantially the same speed as the subsequent conveyor 30. Accordingly, the conveyor 16 is decelerated from a greater speed to a lesser speed as the leading edge transverses the distance or a portion of the distance between the sensor 24 and the end of the conveyor 16. For example, the beginning of deceleration is delayed after initial sensing of the leading edge. Deceleration may occur a time period after sensing the leading edge of the subsequent article of laundry 34 or occur a time period after having sensed the trailing edge of the previous article of laundry 36. The increased speed of the conveyor 16 is maintained only for a time period that is responsive to the detection of the leading edge of the subsequent article of laundry 34.

As shown in FIG. 3, the trailing portion of the prior article of laundry 36 hangs down in the gap between the conveyors 16 and 30. The conveyor 16 begins deceleration such that the gap continues to be decreased but at a lesser rate. By the time the subsequent article of laundry 34 is being passed from the conveyor 16 to the subsequent conveyor 30, the conveyor 30 is at a same or greater speed than the conveyor 16 so that wrinkles are not introduced. When the article of laundry 34 is initially passed from the upstream conveyor 16 to the downstream conveyor 30, the air from the air tube 26 is off so that the article of laundry passes to the downstream conveyor 30 without falling between the gap of the conveyor 16 to the conveyor 30.

As shown in FIG. 4, the acceleration of the conveyor 16 relative to the conveyor 30 results in a decrease in the gap between the articles of laundry 36 and 34. Due to the acceleration of the conveyor 16, a greater gap may be introduced between subsequent articles of laundry on the conveyor 16. Alternatively, the processing of the station providing articles of laundry to the conveyor 16 speeds up or has sufficient operating capability to continue to place articles of laundry on the conveyor 16 without further increases in a gap as the processing continues. For example, the station 12 is a spreader-feeder station with multiple operator stations for continually providing articles of laundry, but a single operator station may be used.

In an alternative embodiment, the upstream conveyor 16 operates at a speed that is faster than the downstream conveyor 30. For example, in-feed conveyors of some ironers are operated at around 10% lesser speed than the subsequent ironing operation. The conveyor 16 feeding a slower in-feed conveyor 30 may be configured to operate at a speed substantially the same or slightly less than the ironer but greater than the speed of the in-feed conveyor 30 to the ironer. Gaps between articles of laundry provided by the conveyor 16 are reduced by selective deceleration. For example, a leading edge of a first article of laundry on the conveyor 16 is sensed. The leading edge is sensed at a point or location spaced from an end of the conveyor, such as sensing at the position of the sensor 24. The first conveyor 16 is decelerated in response to sensing the leading edge of the article of laundry. The conveyor 16 is decelerated to a speed that is substantially the same, such as the same or slightly less than the speed of the conveyor 30. The deceleration is set such that the leading edge of the article of laundry on the conveyors 16 and 30 is adjacent to the end of the conveyor 16 when deceleration ends. At this time, the speed of conveyor 16 is faster than conveyor 30 but slightly slower than roller 14. The leading edge passes to the in-feed conveyor 30 with no or few wrinkles. A trailing edge of the same article of laundry is sensed. By the time that the trailing edge of the same article of laundry is sensed, the article of laundry is both on the upstream conveyor 16 and the downstream conveyor 30. The trailing edge is sensed at a point spaced from the end of the conveyor 16, but may be sensed at the end of the conveyor 16 in alternative embodiments. Once the trailing edge of the article of laundry is sensed, the conveyor 16 is accelerated. The blower 26 positions the trailing portion of the article of laundry between the conveyor 16 and 30 to avoid wrinkling or bunching of the article of laundry due to the conveyor 16 accelerating to a speed greater than the conveyor 30. The acceleration occurs at a time such that the trailing edge of the article of laundry is near the end of the conveyor 16. In alternative embodiments, the acceleration begins after a time period without sensing a trailing edge of the article of laundry or begins where the trailing edge is spaced away from the end of the conveyor 16.

In other embodiments, gaps between successive articles of laundry are reduced within a laundry station. For example, a folder station includes two or more conveyors, such as a conveyor for each of two different folds. The upstream conveyor operates as discussed above to accelerate and/or decelerate in response to a sensor for reducing gaps between articles of laundry. Any of the various stations disclosed herein or other stations may reduce gaps as discussed herein.

While the invention has been described above by reference to various embodiments, it will be understood that many changes and modifications can be made without departing from the scope of the invention. For example, in the various combinations of sensing portions of articles of laundry and accelerating or decelerating, one or both of the conveyors 16 and 30 may be used. The system for reducing the gaps may be independent of either station, such as a free standing station between two other stations. It is therefore intended that the foregoing detailed description be understood as an illustration of the presently preferred embodiment of the invention and not as a definition of the invention. It is only the following claims, including all equivalents, that are intended to define the scope of this invention.

What is claimed is:

1. A method for reducing gaps between articles of laundry passing between two laundry processing stations, the method comprising:

(a) sensing a gap between a first article of laundry and a second article of laundry; and (b) accelerating a first conveyor supporting the second article of laundry in response to (a);

wherein the gap between the first and second articles of laundry decreases in response to the acceleration.

2. The method of claim 1 wherein (b) comprises accelerating the first conveyor to a first speed that is faster than a second speed of a second conveyor, the second conveyor supporting the first article of laundry, the first conveyor conveying the second article of laundry towards the second conveyor and the second conveyor conveying the first article of laundry away from the first conveyor;

further comprising:

(c) decelerating the first conveyor to substantially the second speed once a leading edge of the second article of laundry is adjacent to the second conveyor.

3. The method of claim 1 wherein (b) comprises accelerating the first conveyor to be faster than the second conveyor for a time period responsive to the length of the gap;

further comprising:

(c) decelerating the first conveyor after the time period.

4. The method of claim 1 wherein (a) comprises detecting a trailing edge of the first article of laundry.

5. The method of claim 1 wherein (a) comprises detecting a trailing edge of the first article of laundry followed by detecting a leading edge of the second article of laundry.

6. The method of claim 5 further comprising:

(c) keeping a first speed of the first conveyor higher than a second speed of the second conveyor only for a time period responsive to detection of the leading edge of the second article of laundry.

7. The method of claim 1 wherein (b) comprises accelerating the first conveyor to a speed more than 10% faster than the second conveyor.

8. The method of claim 1 further comprising:

(c) applying air force to a trailing portion of the first article of laundry at a gap between the first conveyor and a second conveyor, (c) performed during (b).

9. The method of claim 1 wherein (a) comprises sensing the gap on an output conveyor of an automated laundry feeder station, the first conveyor being the output conveyor of the laundry feeder station, the first and second articles of laundry being conveyed from the laundry feeder station to an input of at least one of: an automated laundry ironer station and an automated laundry folder station.

10. A gap reduction system for passing laundry between two stations, the system comprising:

a first conveyor at an output of a first automated laundry processing station;

a motor connected with the first conveyor;

a sensor positioned adjacent to the first conveyor to detect a gap between two articles of laundry, the sensor positioned to sense tops or bottoms of the articles of laundry; and a controller responsive to the sensor, the controller operative to cause the first motor to accelerate the first conveyor in response to the detection of the gap.

11. The system of claim 10 wherein the controller is operable to cause the first motor to decelerate the first conveyor in response to an end of the gap.

12. The system of claim 10 wherein the first automated laundry processing station comprises a laundry feeder.

13. A gap reduction system for passing laundry between two stations, the system comprising:

a first conveyor at an output of a first automated laundry processing station;

a motor connected with the first conveyor;

a sensor positioned adjacent to the first conveyor to detect a gap between two articles of laundry; and a controller responsive to the sensor, the controller operative to cause the first motor to accelerate the first conveyor in response to the detection of the gap;

wherein the sensor is positioned above the first conveyor over a last half of the first conveyor.

14. A gap reduction system for passing laundry between two stations, the system comprising:

a first conveyor at an output of a first automated laundry processing station;

a motor connected with the first conveyor;

a sensor positioned adjacent to the first conveyor to detect a gap between two articles of laundry; and a controller responsive to the sensor, the controller operative to cause the first motor to accelerate the first conveyor in response to the detection of the gap;

further comprising:

an air tube positioned adjacent an exit end of the first conveyor.

15. A gap reduction system for passing laundry between two stations, the system comprising:

a first conveyor at an output of a first automated laundry processing station;

a motor connected with the first conveyor;

a sensor positioned adjacent to the first conveyor to detect a gap between two articles of laundry; and a controller responsive to the sensor, the controller operative to cause the first motor to accelerate the first conveyor in response to the detection of the gap;

wherein the sensor connects with the first automated laundry processing station and the controller is also operable to control at least one additional function of the first automated laundry processing station.

16. A gap reduction system for passing laundry between two stations, the system comprising:

a first conveyor at an output of a first automated laundry processing station;

a motor connected with the first conveyor;

a sensor positioned adjacent to the first conveyor to detect a gap between two articles of laundry; and a controller responsive to the sensor, the controller operative to cause the first motor to accelerate the first conveyor in response to the detection of the gap;

further comprising:

a second automated laundry processing station having an input, the input positioned adjacent to the first conveyor such that the first conveyor is operable to transfer articles of laundry to the input without operator contact.

17. A method for reducing gaps between articles of laundry passing between two laundry processing stations, the method comprising:

(a) sensing a trailing edge of a first article of laundry on a first conveyor; and (b) accelerating the first conveyor in response to (a);

(c) sensing the leading edge of a second article of laundry on the first conveyor; and (d) decelerating the first conveyor in response to (c).

18. The method of claim 17 wherein (b) comprises accelerating the first conveyor to a first speed that is faster than a second speed of a second conveyor, the second conveyor disposed to receive the first and second articles of laundry from the first conveyor, and wherein (d) comprises decelerating the first conveyor to substantially the second speed after sensing the leading edge and before the leading edge reaches the second conveyor.

19. The method of claim 17 wherein (a) and (c) comprise sensing a gap between the first and second articles of laundry, and (b) and (d) comprise accelerating the first conveyor to be faster than a second conveyor for a time period responsive to the length of the gap and then decelerating the first conveyor.

20. The method of claim 17 further comprising:

(c) applying air force to a trailing portion of the first article of laundry at a gap between the first conveyor and a second conveyor disposed to receive the first article of laundry from the first conveyor.

21. A method for reducing gaps between articles of laundry passing between two laundry processing stations, the method comprising:

(a) sensing a leading edge of a first article of laundry on a first conveyor;

(b) decelerating the first conveyor in response to (a);

(c) sensing a trailing edge of the first article of laundry; and (d) accelerating the first conveyor in response to (c).

22. The method of claim 21 wherein (b) comprises decelerating the first conveyor to a speed substantially the same as a speed of a second conveyor.

23. The method of claim 21 wherein (a) comprises sensing the leading edge at a point spaced from an end of the first conveyor; and further comprising:

(e) beginning (b) at a time such that the leading edge of the first article is adjacent to the end of the first conveyor when deceleration ends.

24. The method of claim 21 wherein (c) comprises sensing the leading edge at a point spaced from an end of the first conveyor; and further comprising:

(e) beginning (d) at a time such that the trailing edge of the first article of laundry is adjacent to the end of the first conveyor.

25. The method of claim 1 further comprising:

(c) applying vacuum force to a trailing portion of the first article of laundry at a gap between the first conveyor and a second conveyor, (c) performed during (b).

26. The system of claim 14 further comprising a vacuum source connected with the air tube.

27. The system of claim 14 further comprising a valve connected with the air tube to release air from the air tube.

28. The method of claim 17 further comprising:

(c) applying vacuum force to a trailing portion of the first article of laundry at a gap between the first conveyor and a second conveyor disposed to receive the first article of laundry from the first conveyor.

* * * * *